US007041072B2

(12) United States Patent
Calvert

(10) Patent No.: US 7,041,072 B2
(45) Date of Patent: May 9, 2006

(54) MASSAGER AND METHOD OF USING SAME

(75) Inventor: Jay Wynn Calvert, Costa Mesa, CA (US)

(73) Assignee: Matrix Surgical Consulting Corporation, San Juan Capistrano, CA (US)

( * ) Notice: Subject to any disclaimer, the term of this patent is extended or adjusted under 35 U.S.C. 154(b) by 0 days.

(21) Appl. No.: 10/887,194

(22) Filed: Jul. 8, 2004

(65) Prior Publication Data

US 2004/0243031 A1 Dec. 2, 2004

Related U.S. Application Data

(62) Division of application No. 10/080,350, filed on Feb. 21, 2002, now abandoned.

(51) Int. Cl.
*A61H 23/02* (2006.01)

(52) U.S. Cl. ..... 601/111; 601/108; 128/898

(58) Field of Classification Search ..... 601/17, 601/19, 46, 70, 80, 101, 103, 107, 108, 110, 601/111, 129, 130, 131, 134, 135; 128/898
See application file for complete search history.

(56) References Cited

U.S. PATENT DOCUMENTS

| | | | | |
|---|---|---|---|---|
| 3,705,578 | A | 12/1972 | Cutler | |
| 3,926,180 | A | 12/1975 | Zambelli | |
| 4,048,989 | A * | 9/1977 | Schaefer | 601/108 |
| 4,086,922 | A * | 5/1978 | Henderson | 601/19 |
| 4,098,266 | A | 7/1978 | Muchisky | |
| 4,102,334 | A | 7/1978 | Murchisky | |
| 4,150,668 | A | 4/1979 | Johnston | |
| 4,401,109 | A | 8/1983 | DeJong | |
| 4,604,993 | A | 8/1986 | Moriwaki | |
| 4,727,875 | A | 3/1988 | Dory | |
| 4,730,605 | A | 3/1988 | Nobel | |
| 4,825,853 | A | 5/1989 | Iwamoto | |
| 4,958,628 | A | 9/1990 | Iwamoto | |
| 5,123,406 | A | 6/1992 | Masuda | |
| 5,140,979 | A | 8/1992 | Nakagawa | |
| 5,247,925 | A | 9/1993 | Yamasaki et al. | |
| 5,279,284 | A | 1/1994 | Fenn | |
| 5,471,695 | A | 12/1995 | Aiyar | |
| 5,471,696 | A | 12/1995 | Linfoot | |
| 5,716,332 | A | 2/1998 | Nobel | |
| 5,925,002 | A | 7/1999 | Wollman | |
| 6,165,145 | A | 12/2000 | Noble | |
| 6,254,555 | B1 | 7/2001 | Sevier et al. | |
| 6,381,497 | B1 | 4/2002 | Knowlton | |
| 6,511,445 | B1 * | 1/2003 | Sivan et al. | 601/17 |
| 6,517,499 | B1 * | 2/2003 | Pereira | 601/133 |
| 6,592,595 | B1 * | 7/2003 | Mallett et al. | 606/131 |

FOREIGN PATENT DOCUMENTS

| | | |
|---|---|---|
| WO | WO00/38613 | 7/2000 |

* cited by examiner

*Primary Examiner*—Quang D. Thanh
(74) *Attorney, Agent, or Firm*—Pepper Hamilton LLP

(57) ABSTRACT

The invention relates to a method of operating a percussive massage device for smoothing the skin and fat irregularities associated with any liposuction procedure including suction assisted lipectomy, ultrasonic assisted lipectomy, and direct lipectomy; improving the contour irregularities assisted with any liposuction procedure; preconditioning the skin and fat prior to any liposuction procedure to minimize blood vessel damage; removing scar tissue from patients who have recently undergone any liposuction procedure, and treating skin irregularities due to "cellulite".

6 Claims, 6 Drawing Sheets

PRIOR ART

PRIOR ART

MASSAGER AND METHOD OF USING SAME

CROSS REFERENCE TO RELATED APPLICATIONS

The present application is a divisional of U.S. application Ser. No. 10/080,350, entitled "Massager and Method of Using Same," as filed on Feb. 21, 2002, now abandoned, herein incorporated by reference in its entirety.

BACKGROUND OF THE INVENTION

Aesthetic body contour surgery has become a routine procedure by which to increase the attractiveness of the human form. One particular method of body contour surgery, suction lipectomy or liposuction, is a procedure that permits elimination of localized fat deposits through small incisions, which leave inconspicuous scars. Liposuction is one of the most common aesthetic procedures performed by plastic and reconstructive surgeons today.

Liposuction has been used to remove fat from many regions of the body. The regions most frequently treated include the trochanteric region, flanks, buttocks, interaspect of the knee, the anterior abdominal wall, gynecomastia, and "love handles." Although it was once believed that the fat cells removed by liposuction would later be replaced, the presently accepted theory is that the body contains a limited number of fat cells, which cannot regenerate. Fatty tissue is not caused by an increase in the number of fat cells, but by an increase in the amount of lipid matter found within the cell. Therefore, the removal of fat cells by liposuction should create a contour that will retain its form (absent undue expansion of lipid matter in remaining cells).

Liposuction was first performed in Europe by J. Schrudde in 1972 using a uterine curette. Currently, the procedure is performed using a special type of curette known as a cannula. The cannula is attached to a vacuum source, which carries away the fat tissue. The vacuum required is inversely proportional to the size of the suction aperture and the tube diameter (i.e., the smaller the tube and the orifice, the higher the negative pressure needed for the evacuation of the fat). The vacuum pressure in one often used cannula, known as the Aspiradeps, manufactured by Ulrich A. G., in St. Gall, Switzerland, is usually on the order of 0.4 to 0.6 atmospheres.

There are theoretically two different methods by which to remove fat through liposuction. The first of these methods is the tunneling procedure as proposed by Y. G. Illouz. In the Illouz method, one or two incisions are made. Radial excursions of the instrument into the flesh via the incisions are then made. The result is a multitude of concomitant sinuses. The second method is the original liposuction procedure as proposed by U. K. Kesserling. In the second technique, an entire layer of regular, deep fat is removed, leaving a smooth, deep surface of residual panniculus. The space created is then transformed by compression into a virtual space in which primary healing can take place. Optimally, skin retractions may follow.

Both of the above techniques require the surgeon to push and pull a portion of the cannula back and forth multiple times for each tunnel made. Generally, twenty to thirty tunnels per incision are made to insure even removal of fat in the targeted regions. The surgeon typically massages the flesh in the area of the aperture in the cannula, while at the same time thrusting the rod in and out of the tunnel. This method is extremely traumatic, both for the patient and the doctor. Many surgeons practicing liposuction find it physically taxing, and most come out of the operating room extremely tired after procedures in which large areas are liposuctioned. Moreover, the removal of deep fat causes damage to blood vessels thereby causing the patient's flesh to turn black and blue for several days.

Furthermore, the removal of deep fat causes inflammation of the soft tissue post-operatively. Inflammation of soft tissue areas of the human body may occur as the result of a major trauma, such as surgery including liposuction procedures. The body responds by forming fibrous adhesions, or scar tissue, which is an unavoidable by-product of the healing process. The scar tissue forms in soft tissue areas of the human body, such as muscles, tendons, and ligaments. As scar tissue builds up, it prevents the muscles, tendons, and ligaments from lengthening and contracting, thereby resulting in lost range of motion, pain, and decreased stability.

Scar tissue is removed by a process known as soft tissue therapy, which involves the manually massaging of the skin over the affected soft tissue areas to release scar tissue adhesions to regain lost resting length in the tissue. This type of massage includes cross-frictional massage, deep muscle massage, and rolling. One problem associated with manual massage of soft tissue areas is the difficulty in applying the appropriate amount of manual pressure. In some instances, too much pressure may be exerted on some soft tissue areas, thereby causing unnecessary discomfort to the patient. In other instances in which hardened scar tissue has built up on tendons and ligaments near bone surfaces, manual massage pressure may not be sufficient pressure to provide an effective treatment. In addition, it is frequently difficult to manually locate scar tissue with sufficient specificity using one's hand. Furthermore, it has been found that performing manual massage for an extended period of time may result in hand injuries to the person performing the massage such as tendonitis.

Therefore, it is desirable to provide a massage device that can be used: 1) pre-operatively to condition and loosen the fat in preparation for liposuction to minimize blood vessel damage; 2) intra-operatively during a liposuction procedure where the operating surgeon will immediately use the massage device to smooth the tissue after removing the fat to minimize scar tissue build up; and 3) post-operatively on patients who have undergone a liposuction procedure within at least one year to massage and remove the scar tissue

SUMMARY OF THE INVENTION

The present massage device is capable of performing the following functions, including, but not limited to: 1) smoothing of skin and fat irregularities associated with any liposuction procedure including suction assisted lipectomy, ultrasonic assisted lipectomy, and direct lipectomy; 2) improving the contour irregularities assisted with any liposuction procedure; 3) preconditioning the skin and fat prior to any liposuction procedure to minimize blood vessel damage; 4) removing scar tissue from patients who have recently undergone any liposuction procedure; and 5) treating skin irregularities due to "cellulite".

Therefore, the present invention provides a massager having at least one massage node to be used before, during, and after any liposuction procedure. Accordingly, a massager having independently movable massage nodes is provided. The massager has a housing that includes a base portion and a handle portion.

Still further, the housing is preferably constructed from titanium or stainless steel and assembled from a top housing part and a bottom housing part. Also, the housing is preferably made watertight. Alternatively, the massager further comprises a disposable sterile plastic bag to assure sterility while preventing fluid, tissue, or other materials from penetrating the housing and getting into the electronics of the massager.

According to a preferred embodiment, the massage nodes are hemispherically shaped, have an internal frame constructed from a plastic material, and have an exterior surface constructed from a resilient material to impart the percussive massage effect.

The above objects and other objects, features, and advantages of the present invention are more readily understood from a review of the attached drawings and the accompanying specification and claims.

DETAILED DESCRIPTION OF THE INVENTION

Figure 1:
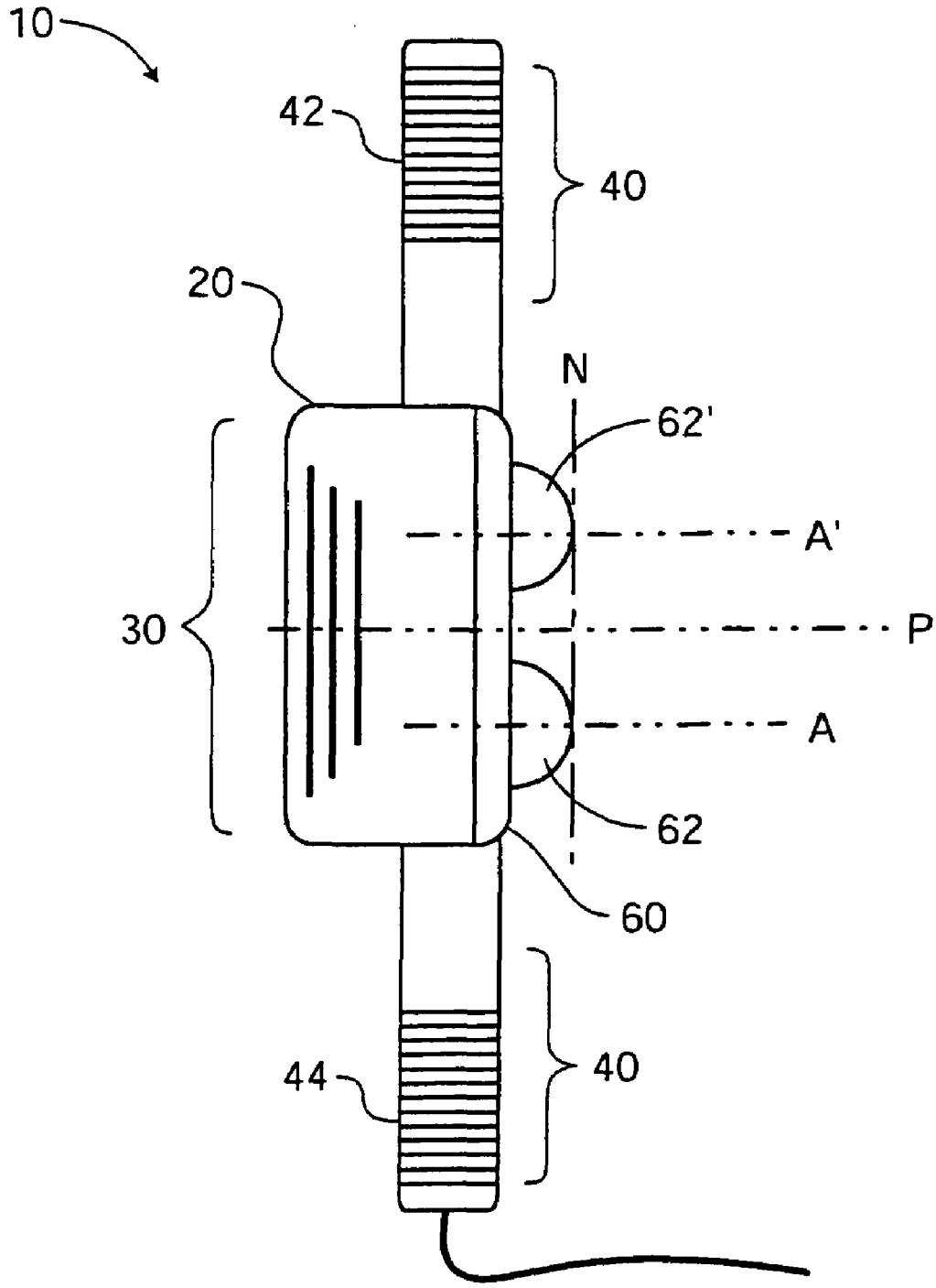
FIG. 1 is a side view of the massager 10 in accordance with the present invention.
Figure 2:
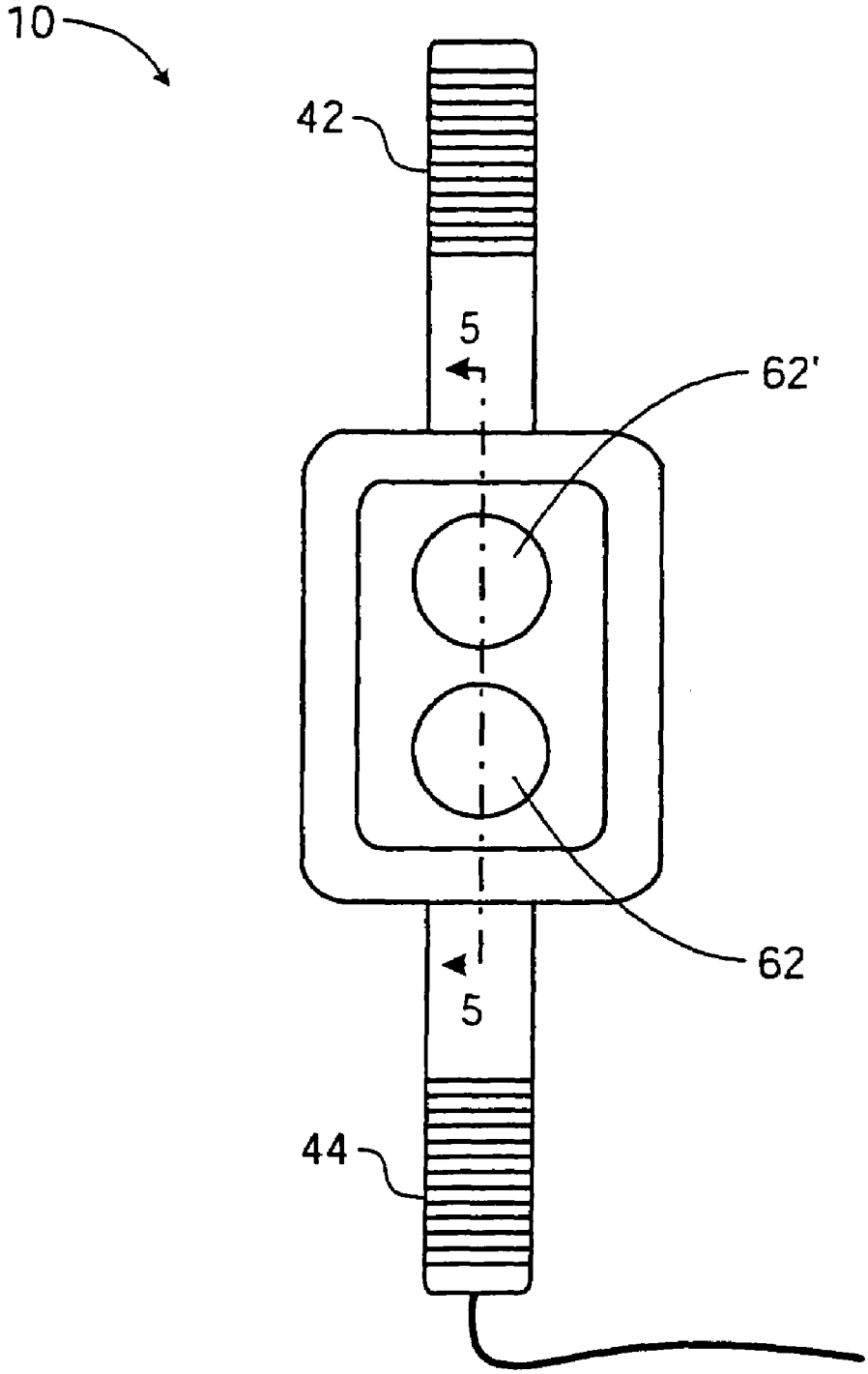
FIG. 2 is a bottom plan view of the massager 10 having two massage nodes 62.
Figure 3:
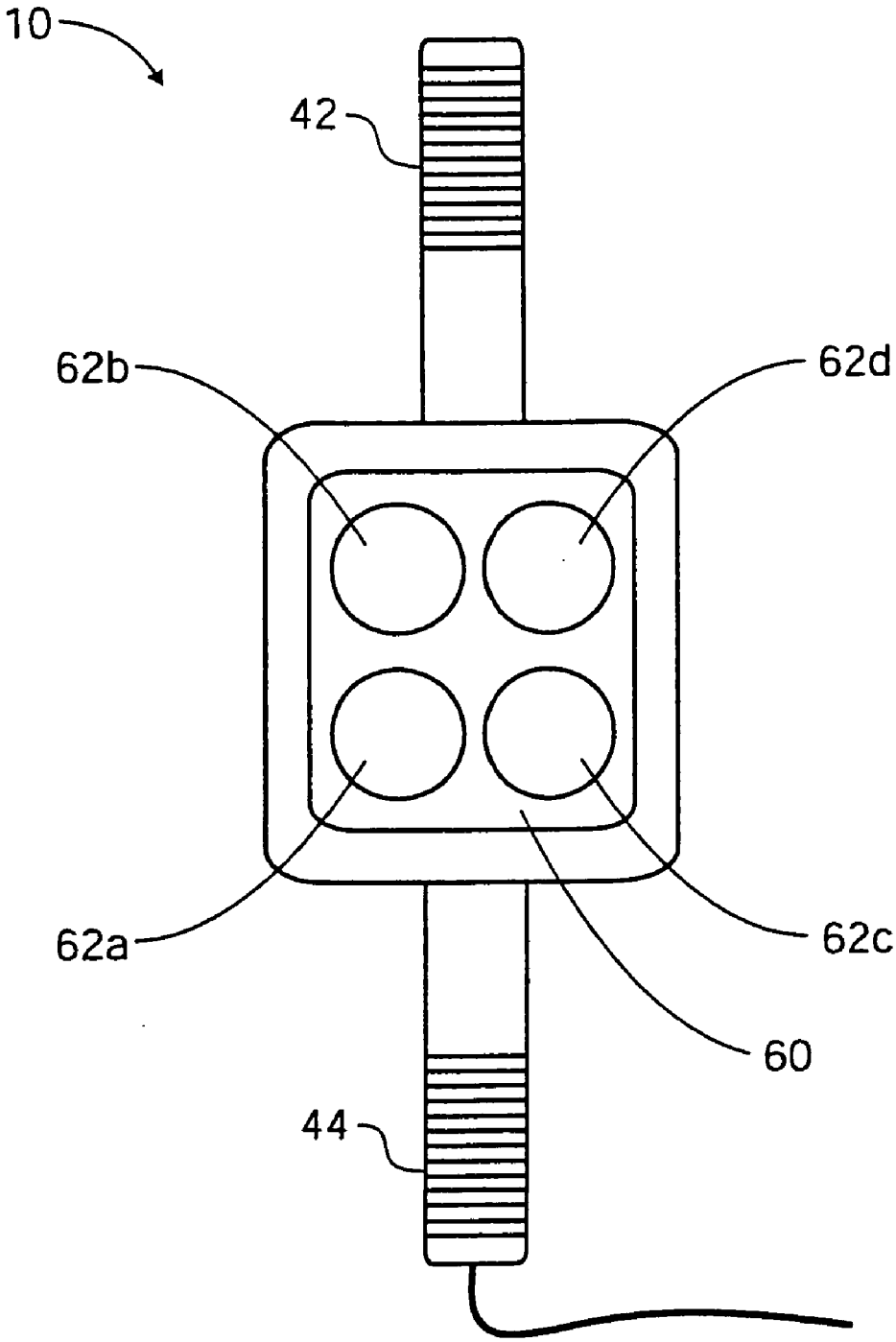
FIG. 3 is a bottom plan view of the massager 10 having four massage nodes 62.

Referring to FIGS. 1–3, a massager in accordance with the preferred embodiment of the present invention is shown and indicated by reference numeral 10. Massager 10 comprises a housing 20 formed generally as two portions, a base portion 30 and a handle portion 40. The handle portion 40 preferably includes two handles 42, 44 that are disposed on opposite sides of the base portion 30.

The base portion 30 includes a drive unit 50 housed within the base portion 30 and a massage head 60 having an external massage surface that is contoured symmetrically about a median plane P generally perpendicular to a notional plane N representing a surface to be massaged. The actual massage surface of the massage head 60 is, in this embodiment, defined by a pair of generally hemispherical massage nodes 62 which are symmetrical about plane P. The massage head 60 is situated in such a way as to provide for movement of the massage nodes 62 about axes A and A' disposed parallel to the median plane P. The drive unit 50 is coupled to the massage nodes 62 by coupling means 70 known in the art. The coupling means 70 permit the massage nodes 62 to reciprocate along the axes A and A' at a position spaced apart from the median plane P to thereby produce asynchronous movement of the massage heads 62.

Figure 4:
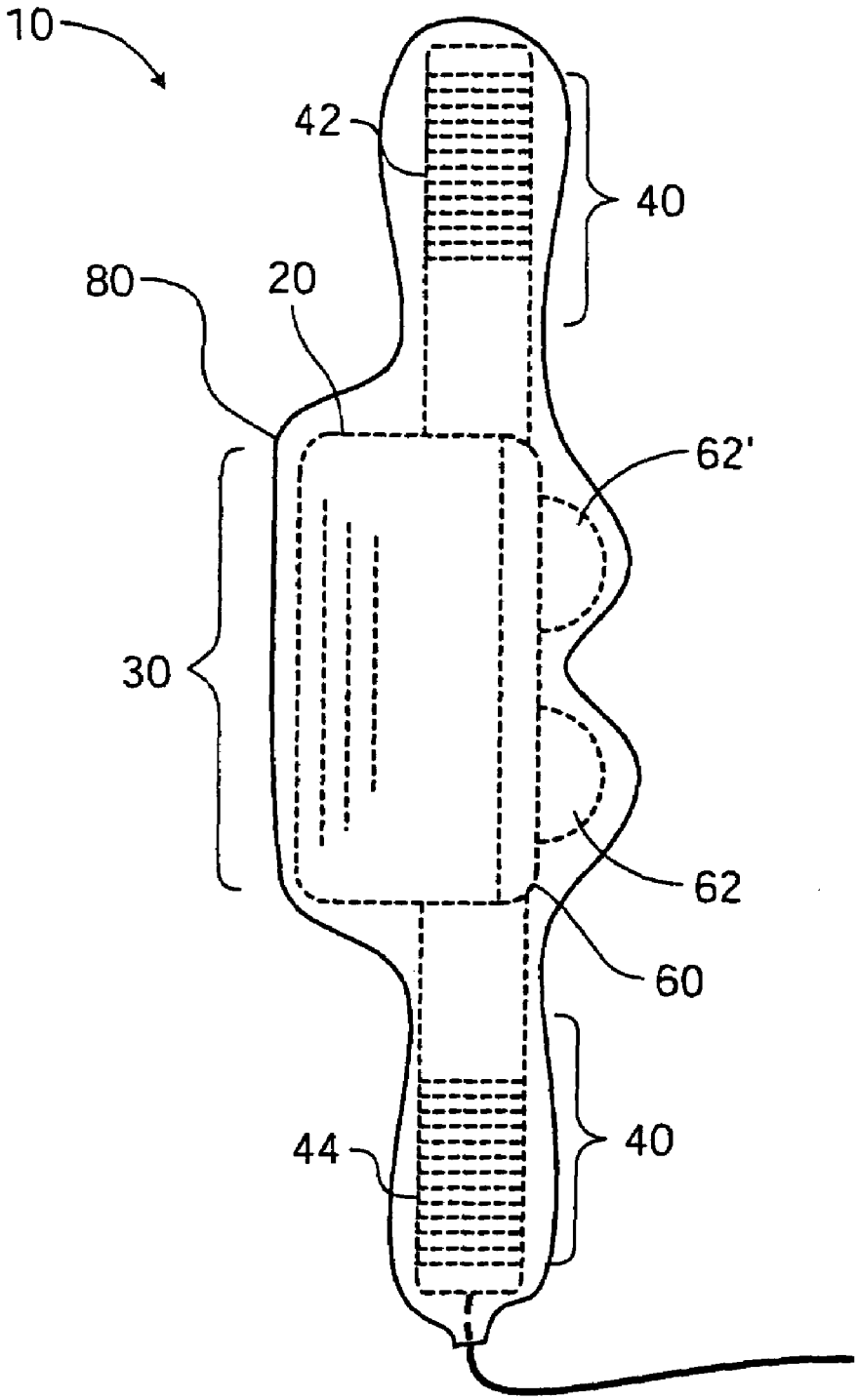
FIG. 4 is a side view of the massager 10 utilizing a disposable sterile bag 80 during operation.

In the preferred embodiment, the housing 20 is generally shaped like a flat "T." However, one skilled in the art would appreciate that the housing may be straight, curved, angled and/or adjustable depending on the region of the body to be treated. Because the massager 10 may be used during any liposuction proceeding (e.g., pre-operatively, intra-operatively, and post-operatively), it is preferred that the housing 20 be waterproof such that chemicals or bodily fluids are prevented from penetrating into the electrical and mechanical components within the housing 20. The housing 20 itself can be constructed by any means necessary to ensure water tightness including, but not limited to, tongue and groove edges, use of a gasket and/or o-rings, or any other means known in the art. Alternatively, as shown in FIG. 4, the massager 10 may be placed into a disposable sterile plastic bag 80 and operated while in the plastic bag during the liposuction procedure. The plastic bag 80 will ensure that the massager is isolated from any fluids, tissue, or other contaminating materials and also reduces the need to clean the massager 10 since the bag 80 is disposable. Furthermore, the housing must be constructed of a material that is sufficient for use in an operating room, surgeon's office, or any other medical office. Accordingly, the housing should be constructed of titanium, stainless steel, aluminum alloy, or any other chemically resistant metal or metal alloy. Also, any chemically resistant plastics may be utilized especially when a disposable sterile bag 80 is used during the massaging procedure.

The handle arrangement of the preferred embodiment has been found to be particularly useful in that it allows the massager 10 to be held in an almost infinite variety of positions as required by the particular treatment being given. However, it is contemplated that the handle arrangement may be varied to treat any region of the body. Although the preferred embodiment includes two handles 42, 44 disposed on opposite sides of the base portion 30 and parallel to the notional plane N, the two handles 42, 44 may be arranged in any fashion. In another embodiment, one handle 42 may be disposed parallel to the notional plane N similar to the preferred embodiment, while the other handle 44 may be disposed 90 degrees from the handle parallel to the notional plane N. In other words, the two handles 42, 44 are disposed mutually at right angles from each other and are parallel to the notional plane N. Furthermore, one skilled in the art would understand and appreciate that the massager may incorporate only one handle or more than two handles and still be within the scope of the invention. Additionally, one or more of the handles may be adjustable. Also, the handles may be preferably contoured to facilitate a user's grasp and may be provided with a foam cushion to provide an operator with an easy and comfortable grip.

In the preferred embodiment, the massage surface is shown as being provided by two hemispherical shaped massage nodes 62, but it is to be understood that a larger number of semi-hemispherical shaped massage nodes could be provided symmetrically about plane P. The number of massage nodes 62 may be between 2 and 50. See FIG. 3 which illustrates the addition of two massage nodes 62. Reference may be made to U.S. Pat. No. 4,730,605 for an illustration of a multiple hemispherical shaped massage nodes 62 and which is hereby incorporated by reference in its entirety. It is understood, of course, that each massage node 62 can have any shape and size suitable to impart the desired massage effect. Also, the size and/or shape of one massage node 62 may be different than the size and/or shape of another massage node 62 on the same massager 10. Preferably, the size of the massage nodes is between about 1 cm and about 10 cm in diameter. Massage nodes 62 preferably have a plastic internal frame that includes a tapped cylinder such that each massage node can be fastened to the frame with a screw. On the exterior surface, massage nodes 62 comprise a resilient, preferably rubber, material. Preferably, alternate sets (not shown) of massage nodes 62 are provided for attachment to massager 10 of the present invention. The sets of massage nodes 62 would be of different densities to provide the options of soft, medium, or hard massage application. To change to a different set, an operator can simply unscrew the set that is currently attached to massager 10 via the screws and screw in the desired set. It is also contemplated that the massage nodes may be spaced apart a certain distance and that distance may be adjustable by any means known in the art.

Figure 5:
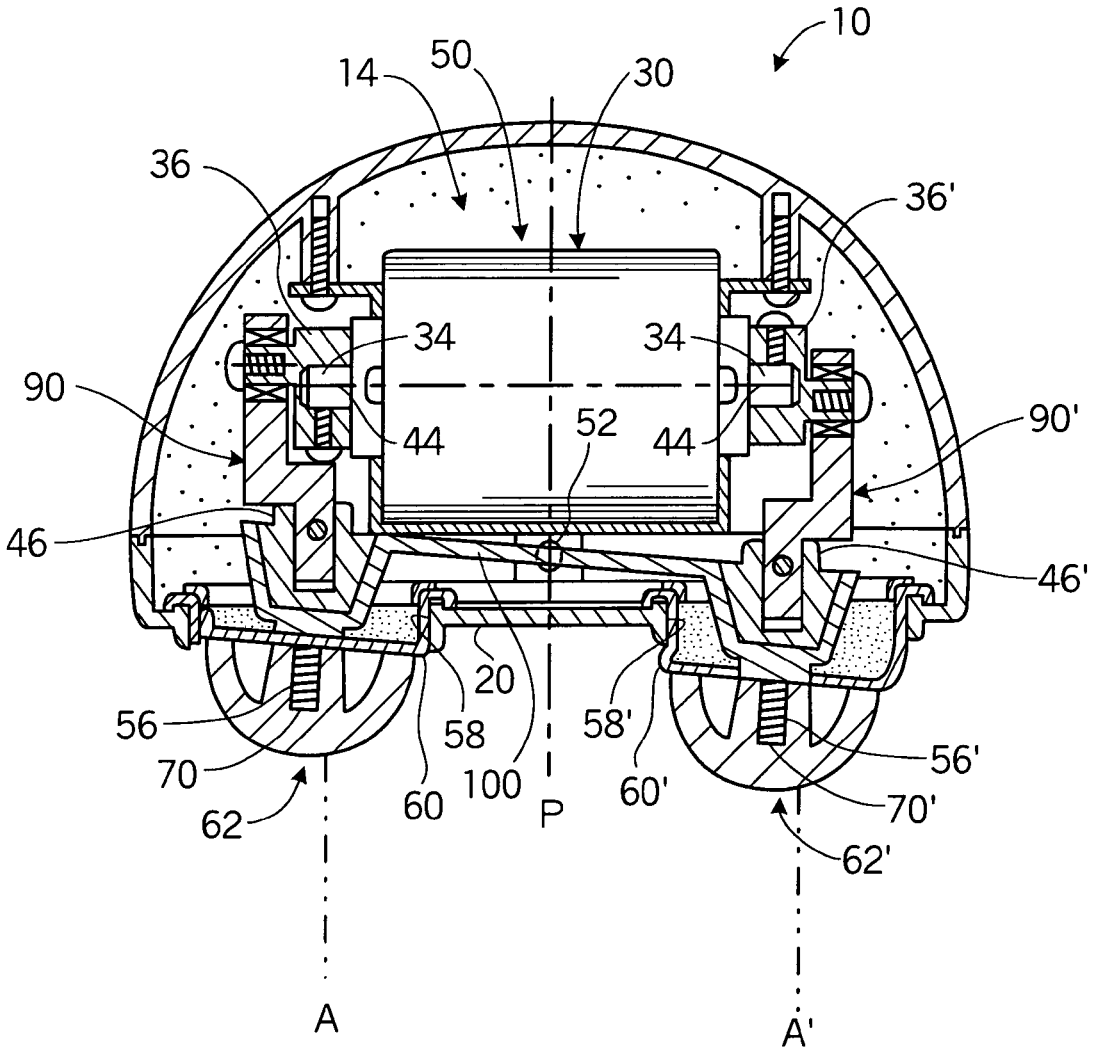
FIG. 5 is a cross-sectional view of the base portion 30 of the massager 10 taken along line 5—5 of FIG. 2 illustrating a motor as the drive unit of a prior art having an output shaft protruding from both sides of the motor.
Figure 6:
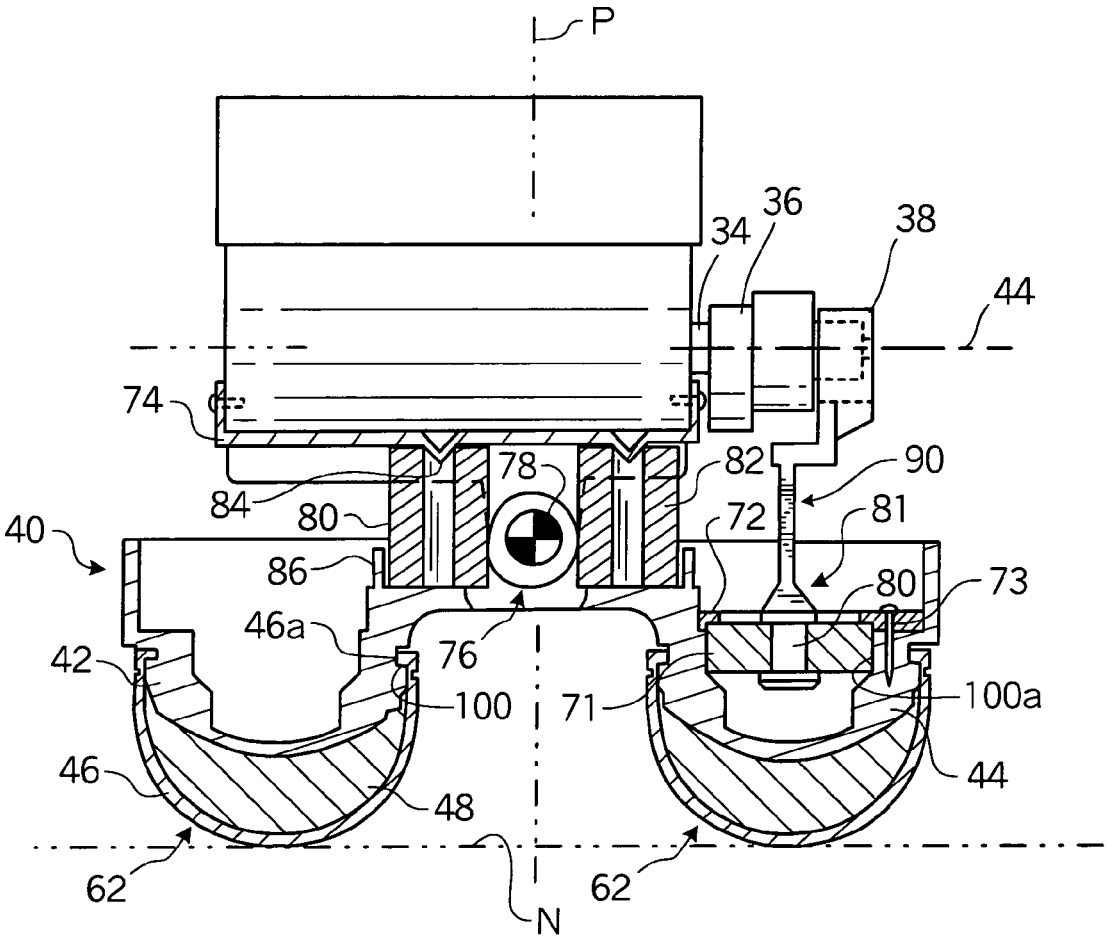
FIG. 6 is a cross-sectional view of the base portion 30 of the massager 10 taken along line 5—5 of FIG. 2 illustrating a motor as the drive unit of a prior art having an output shaft protruding from only one side of the motor.

Referring now to the cross-section view of FIG. 5 (taken along line 5—5 of FIG. 2), massager 10 is provided with a drive unit 50 to produce motion and transmit the motion via coupling means 70 and 70' to the massage nodes 62 and 62' thereby producing asynchronous movement of the massage heads 62 and 62' along axes A and A' in a direction generally parallel to the median plane P. In the preferred embodiment, the drive unit 50 is an electric motor 30 that is disposed within the base portion 30 of the housing 20 and is capable of producing percussive motion utilizing means known in the art. The motor rotates an output shaft that protrudes from the motor 30 on either side (see FIG. 6) or both sides thereof (see FIG. 5). Reference may be made to U.S. Pat. No. 5,716,332 for an illustration of the mechanics of a percussive massager wherein the output shaft protrudes from only one side of the motor and is hereby incorporated by reference in its entirety. Reference may be made to U.S. patent application Ser. No. 2001/0027280 A1 for an illustration of the mechanics of a percussive massager wherein the output shaft protrudes from the motor on both sides thereof and is hereby incorporated by reference in its entirety. Preferably, the motor operates under AC voltage when a transformer is installed within the massager 10. However, the motor may operate under DC voltage thereby allowing the massager 10 to be powered by batteries or the like. Also, the motor is capable of providing variable speeds and may be adjustable by the user.

An example of the coupling means is shown in FIG. 5 which illustrates the drive unit as a motor wherein the output shaft protrudes from the motor on both sides thereof. On one side of motor 30 the connecting pole 90 is attached to the wheel 36 in a first offset location, such as above a longitudinal axis 44 of output shaft 34, depicted as the left connecting pole 90 in FIG. 5. On the other side of motor 30' the connecting pole 90' is attached to the wheel 36' at a second offset location. The second offset location is preferably 180 degrees from the first offset location, such as below longitudinal axis 44 of output shaft 34 as depicted for the right connecting pole 90' in FIG. 5. Therefore, as output shaft 34 rotates, connecting poles 90 and 90' are moved up and down asynchronously due their different eccentric attachment locations. Although the above example is the preferred coupling means, one skilled in the art would recognize that other coupling means are possible such as the use of a "single" coupling means for a single output shaft (which is similar to the above example, but only includes one set of parts), the use of a cam shaft to create the reciprocal axial movement, and other technologies known in the art.

Although the drive unit 50 in the preferred embodiment is a motor, other drive units contemplated include the use of pneumatic components or electromagnetic technologies similar to that of a solenoid. Electromagnetic technology has already been developed for use in combustion engines to open and close valves thereby replacing cam shafts. See U.S. Pat. No. 4,794,890 which is hereby incorporated by reference in its entirety herein. Each massage node 62 and 62' may be coupled to an electromagnet via coupling means known in the art. When the electromagnet is energized, the coupling means forces the massage node 62 and 62' away from the electromagnet thereby producing movement away from the base portion 30. At the same time the one electromagnet is energized, the other electromagnet coupled to the other massage node 62 is de-energized and pulling the massage node 62 towards the electromagnet thereby producing movement towards the base portion 30. When the energizing is synchronized properly, the movement of the massage nodes can produce a percussive effect.

Although the above embodiments describe the massaging effect utilizing percussive motion, one skilled in the art would appreciate that any means may be utilized to create a massaging effect including vibratory motion, rubbing motion, or rolling motion.

In operation, the massager 10 of the present invention and as shown by example in FIG. 5 operates as follows. Motor 30 rotatably drives output shaft 34, which in turn rotates affixed wheels 36 and 36' to cause asynchronous, axial movement of eccentrically attached connecting poles 90 and 90'. Rubber studs 46 and 46' affixed to connecting poles 90 and 90' interface with pressing strip 100 to cause it to move back and forth about its central pivot attachment 52 to the housing 20. From protrusions 54 and 54' formed in pressing plate 100, screws 56 and 56' extend through rubber sleeves 60 and 60' designed to expand and contract through apertures 58 and 58' formed in massage head portion 14 of bottom housing part 20. Massage nodes 62 and 62' which form the massage surface are fastened to these screws 56 and 56', such that the massage nodes 62 and 62' are moved asynchronously and independently by connecting poles 90 and 90' toward and away from massage head 14 to provide a percussive massage effect.

Another embodiment of the present invention includes a massager 10 having only one massage node 62. One skilled in the art would understand and appreciate that providing an output shaft that only protrudes from one side of the drive unit 50 or providing only one electromagnet coupled to the one massage node will result in an operable massager having a single massage node. In operation, rotation of the output shaft or energizing and de-energizing the electromagnet causes the coupling means 70 to reciprocate axially thereby moving the massage node toward and away from the massage head portion creating a percussive massage effect.

The present invention also provides for various methods of using the massagers 10. The massagers 10 may be used to massage skin and fatty tissue. In a preferred embodiment of the present invention, the massager is used to improve the contour of the skin. The massagers 10 may specifically be used to improve contour irregularities associated with "cellulite" or other areas of the skin which do not appear smooth due to underlying fatty tissue. A typical procedure includes providing a massager according to the present invention, identifying an area to be treated such as an area having "cellulite", and applying the massager to the area to be treated to improve contour irregularities in the skin caused by the "cellulite". The massagers 10 will be placed onto the skin and moved over the treatment area in a slow manner. Preferably, the application time is between about 5 minutes to about 15 minutes.

An operator such as a surgeon, physician, or nurse may use the massagers 10 before (i.e., pre-operatively), during (i.e., intra-operatively), or after (post-operatively) any liposuction procedure. During pre-operative use, an operator may use the massagers 10 to condition skin and/or fat in a pre-identified treatment area. By conditioning the skin and/ or fat, the operator essentially loosens up the fatty tissue beneath the skin layer thereby making it easier to suction the fat during the subsequent liposuction procedure and possibly reducing bruising caused by damage to blood vessels. A typical procedure includes providing a massager according to the present invention, identifying an area to be treated, and applying the massager to the area to be treated to condition the skin and/or fat in anticipation of an impending liposuction procedure. The massagers 10 will be placed onto the skin and moved over the treatment area in a slow manner. Preferably, the application time is between about 5 minutes to about 15 minutes.

During intra-operative use, an operator may use the massagers 10 to smooth skin and/or fat in a pre-identified treatment area. By smoothing the skin and/or fat, the operator intends to improve the contour irregularities of the skin caused by the liposuction procedure. A typical procedure includes providing a massager according to the present invention, identifying an area to be treated, and applying the massager to the area to be treated to smooth the skin and/or fat to improve the contour irregularities of the skin. The massagers 10 will be placed onto the skin and moved over the treatment area in a slow manner. Preferably, the application time is between about 5 minutes to about 15 minutes. The application procedure may be repeated a few times during the liposuction procedure in order to help reduce contour irregularities produced during the liposuction procedure. Preferably, the housing 20 of the massagers 10 is either watertight or the massagers 10 is placed into a disposable sterile plastic bag 80 to prevent any fluids, tissue, or other materials from getting into the massagers 10.

During post-operative use, an operator may use the massagers 10 to smooth skin and/or fat in a pre-identified treatment area. By smoothing the skin and/or fat, the operator intends to improve the contour irregularities of the skin caused by the liposuction procedure and remove unwanted scar tissue that forms during the liposuction procedure. A typical procedure includes providing a massager according to the present invention, identifying an area to be treated, and applying the massager to the area to be treated to smooth the skin and/or fat to improve the contour irregularities of the skin. The massagers 10 will be placed onto the skin and moved over the treatment area in a slow manner. Preferably, the application time is between about 5 minutes to about 15 minutes.

It is understood, of course, that while the form of the invention herein shown and described constitutes a preferred embodiment of the invention, it is not intended to illustrate all possible forms thereof. It will also be understood that the words used are words of description rather than limitation, and that various changes may be made without departing from the spirit and scope of the invention disclosed.

What is claimed is:

1. A method of smoothing tissue irregularities in a treatment area during a liposuction procedure comprising the steps of:

providing a percussive massager comprising a housing including a base portions, a handle portion, a drive unit and a massage node, wherein operation of the drive unit causes the massage node to reciprocate axially thereby providing a massage effect;

identifying the tissue to be conditioned which defines a treatment area; and applying the massager to the treatment area to smooth the tissue irregularities during a liposuction procedure thereby improving contour irregularities caused by the liposuction procedure.

2. The method of claim 1, wherein the tissue is skin.

3. The method of claim 1, wherein the tissue is fat.

4. The method of claim 1, wherein the percussive massager is applied to the treatment area following the liposuction procedure to remove unwanted scar tissue formed during the liposuction procedure.

5. The method of claim 1, wherein the percussive massager is applied to the treatment area prior to the liposuction procedure to precondition the tissue thereby minimizing blood vessel damage caused by the liposuction procedure.

6. The method of claim 1, wherein the percussive massager is watertight.

* * * * *